US007828051B2

(12) United States Patent
Walker

(10) Patent No.: US 7,828,051 B2
(45) Date of Patent: Nov. 9, 2010

(54) PERFORATING GUN

(75) Inventor: Jerry L. Walker, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 489 days.

(21) Appl. No.: 11/890,371

(22) Filed: Aug. 6, 2007

(65) Prior Publication Data

US 2009/0038846 A1 Feb. 12, 2009

(51) Int. Cl.
*E21B 43/116* (2006.01)

(52) U.S. Cl. ..... 166/55.1; 102/321.1; 175/4.6

(58) Field of Classification Search ..... 175/4.6; 166/55.1; 102/310, 321, 321.1
See application file for complete search history.

(56) References Cited

U.S. PATENT DOCUMENTS

| | | | | |
|---|---|---|---|---|
| 2,649,046 | A * | 8/1953 | Davis | 102/310 |
| 3,244,101 | A * | 4/1966 | Bell | 102/310 |
| 3,444,810 | A * | 5/1969 | Hakala | 102/310 |
| 3,773,119 | A | 11/1973 | Shore | |
| 4,543,700 | A | 10/1985 | Stout et al. | |
| 4,609,057 | A | 9/1986 | Walker et al. | |
| 4,621,396 | A | 11/1986 | Walker et al. | |
| 4,724,767 | A | 2/1988 | Aseltine | |
| 4,739,839 | A | 4/1988 | Regalbuto et al. | |
| 5,070,943 | A | 12/1991 | Walker et al. | |
| 5,569,873 | A | 10/1996 | Walters et al. | |
| 5,590,723 | A | 1/1997 | Walker et al. | |
| 5,701,964 | A | 12/1997 | Walker et al. | |
| 5,785,130 | A | 7/1998 | Wesson et al. | |
| 6,354,219 | B1 | 3/2002 | Pratt et al. | |
| 6,371,219 | B1 | 4/2002 | Collins et al. | |
| 6,464,019 | B1 | 10/2002 | Werner et al. | |
| 6,748,843 | B1 | 6/2004 | Barker et al. | |
| 6,758,124 | B2 | 7/2004 | Barker et al. | |
| 2005/0183610 | A1 | 8/2005 | Barton et al. | |
| 2006/0075889 | A1 | 4/2006 | Walker | |
| 2006/0102352 | A1 | 5/2006 | Walker | |
| 2006/0108148 | A1 * | 5/2006 | Walker et al. | 175/4.6 |
| 2008/0230225 | A1 * | 9/2008 | Meddes et al. | 166/297 |

FOREIGN PATENT DOCUMENTS

WO 2005/005094 A1 1/2005

OTHER PUBLICATIONS

The International Search Report and The Written Opinion of the International Searching Authority (PCT/US2008/072056); Dec. 29, 2008; 13 pgs.; International Searching Authority; European Patent Office.

Barker, et al.; Hybrid Capsule Charge; United States Statutory Invention Registration; Published Sep. 2, 1997; pp. 1-2; Registration No. H1675; United States Patent Office; Alexandria, Virginia.

International Preliminary Report on Patentability, PCT/US08/072056, Feb. 9, 2010, 7 pages.

* cited by examiner

*Primary Examiner*—Hoang Dang
(74) *Attorney, Agent, or Firm*—William P. Jensen

(57) ABSTRACT

An improved perforating gun having a tubular housing, a tubular carrier and a charge carried by the tubular carrier. The tubular carrier comprises an inside diameter, an outside diameter and an opening disposed between the inside diameter and the outside diameter. The charge comprises a forward end positioned in the opening between the inside diameter and the outside diameter. The tubular carrier increases a collapsible-pressure rating for the housing and positions the charge closer to the formation.

19 Claims, 3 Drawing Sheets

PERFORATING GUN

CROSS-REFERENCE TO RELATED APPLICATIONS

None.

STATEMENT REGARDING FEDERALLY SPONSORED RESEARCH OR DEVELOPMENT

Not applicable.

FIELD OF THE INVENTION

The present invention generally relates to perforating guns of the type generally used to perforate a formation and methods for manufacturing perforating guns.

BACKGROUND OF THE INVENTION

Wellbores are typically drilled using a drilling string with a drill bit secured to the lower free end and then completed by positioning a casing string within the wellbore and cementing the casing string in position. The casing increases the integrity of the wellbore and provides a flow path between the surface and selected subterranean formation for the injection of treating chemicals into the surrounding formation to stimulate production, for receiving the flow of hydrocarbons from the formation, and for permitting the introduction of fluids for reservoir management or disposal purposes.

Perforating has conventionally been performed by means of lowering a perforating gun on a carrier down inside the casing string. Once a desired depth is reached across the formation of interest and the gun is secured, it is fired. The gun may have one or many charges thereon which are detonated using a firing control, which is activated from the surface via wireline or by hydraulic or mechanical means. Once activated, the charge is detonated to penetrate (perforate) the casing, the cement, and to a short distance, the formation. This establishes the desired fluid communication between the inside of the casing and the formation. After firing, the gun is either raised and removed from the wellbore, left in place, or dropped to the bottom thereof.

Perforating guns used in service operations for perforating a formation typically include an elongated tubular outer housing within which is received an elongated tubular carrier, which carries a number of shaped charges. The tubular carrier is located relative to the housing to align shaped charges with reduced-thickness sections of the outer housing. Various means are well known in the art to retain each charge in place, including twist locks, snap rings, tabs and o-rings.

Perforating guns often require a support sleeve to increase the outer housing collapsible-pressure rating, the pressure at which the outer housing will catastrophically deform due to pressure in the wellbore, so that the perforating gun may operate. It is well known in the art that the collapsible-pressure rating can be increased by positioning a support sleeve within the outer housing that is sized to transfer and distribute surrounding pressure from the outer housing to the support sleeve. Because the tubular carrier must be positioned within the support sleeve, typically composed of heavy steel, the shape and size of the charge that can be used is limited. Another disadvantage is that the support sleeve increases the distance between the charge and the formation. As a result, perforation results and/or the collapsible-pressure rating may be compromised. Another disadvantage of the support sleeve is the necessity for zinc charge holders. While zinc is more effectively pulverized than steel and may be dissolved with acid treatment, it is less desirable than steel charge holders that yield better perforating results.

A need, therefore, exists for an apparatus which improves perforation results and the collapsible-pressure rating for a perforating gun. A further need exists for an apparatus which permits the use of steel charge holders.

SUMMARY OF THE INVENTION

The present invention meets the above needs and overcomes one or more of the prior art disadvantages by stabilizing the perforating gun without the need for a separate support sleeve and permitting the use of larger charges, which can be positioned closer to the formation.

In one embodiment, the present invention includes an apparatus for stabilizing a perforating gun having a tubular housing, the apparatus comprising: i) a tubular carrier having a wall and an opening disposed through the wall, wherein the tubular carrier is positioned within the housing and the wall increases a collapsible-pressure rating for the housing; and ii) a charge carried by the tubular carrier, the charge having a wall partially positioned in the opening.

In another embodiment, the present invention includes an apparatus for a perforating gun having a tubular housing, the apparatus comprising: i) a tubular carrier comprising an inside diameter, an outside diameter and an opening disposed between the inside diameter and the outside diameter, wherein the tubular carrier is positioned within the housing and increases a collapsible-pressure rating for the housing; and ii) a charge carried by the tubular carrier, the charge comprising a forward end positioned in the opening between the inside diameter and the outside diameter.

In yet another embodiment, the present invention includes a method for making a perforating gun having tubular housing, the method comprising: i) prepering a tubular carrier, the tubular carrier having an inside diameter, an outside diameter and an opening disposed between the inside diameter and the outside diameter; ii) inserting a charge containing an explosive partially within the opening of the tubular carrier; and iii) inserting the tubular carrier into the housing, the housing comprising an inside diameter that circumferentially meets the outside diameter of the tubular carrier.

These and other objects, features, and advantages of the present invention will become apparent to those skilled in the art from the following description of the various embodiments and related drawings.

BRIEF DESCRIPTION OF THE DRAWINGS

The invention will be described with reference to the accompanying drawings, in which like elements are referenced with like reference numbers, and in which.

DETAILED DESCRIPTION OF THE INVENTION

In the following detailed description of the preferred embodiments, reference is made to the accompanying drawings that form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical changes may be made without departing from the spirit and scope of the present invention. The claimed subject matter thus might also be embodied in other ways, to include structures, steps and combinations similar to the ones described herein, in conjunction with other present or future technologies. The following detailed description is, therefore, not to be taken in a limiting sense, and the scope of the present invention is defined only by the appended claims.

Figure 1:
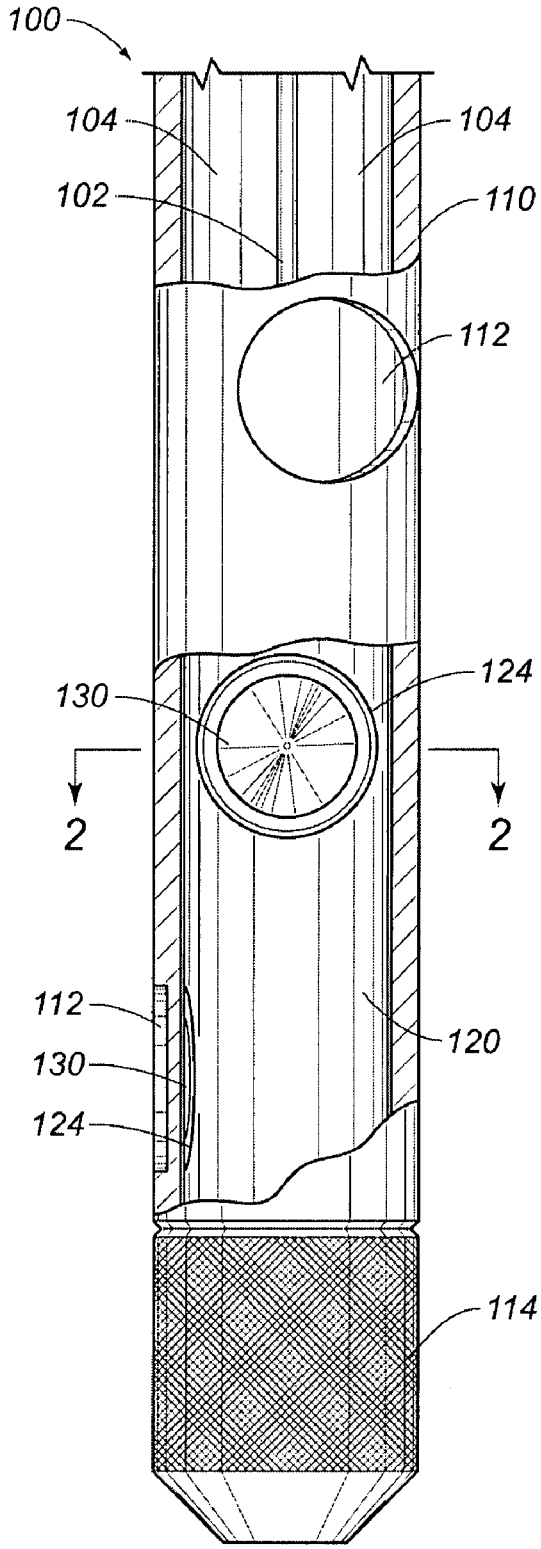
FIG. 1 is a partially-sectioned-elevation view illustrating a perforating gun according to the present invention.
Figure 2:
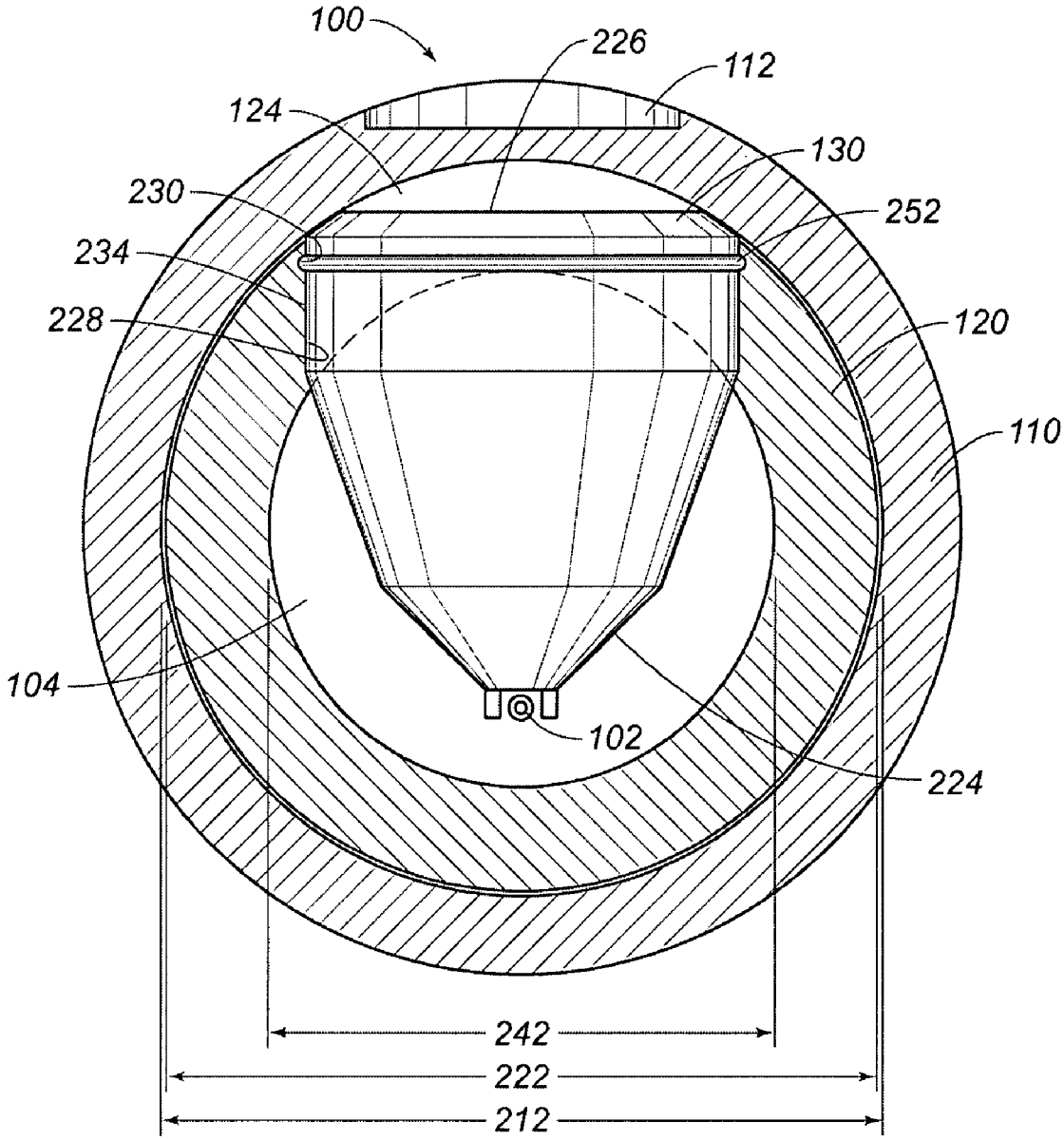
FIG. 2 is a cross-sectional view of the perforating gun along line 2-2 in FIG. 1.

FIG. 1 illustrates a perforating gun 100. The perforating gun 100 includes an elongated tubular outer housing 110, the lower end of which is closed by a bottom plug 114. Typically the bottom plug 114 is threadedly connected to and sealed against housing 110. The housing 110 retains within it an elongated-tubular carrier 120, which carries each charge 130. The tubular carrier 120 includes at least one opening 124 through a wall 228 of the tubular carrier 120 defined between its inside diameter 242 and its outside diameter 222. As illustrated in FIG. 2, each opening 124 is generally circular in shape and is large enough for receipt of charge 130. Each opening 124 may be formed by laser cutting, machining, or other conventional means well known in the art. A detonating cord 102 is disposed through the housing 110, extends above the tubular carrier 120, and is operatively connected to each charge 130. In response to an electrical signal directed down a wireline (not shown) from a surface location, the detonation cord 102 fires each charge 130. Each charge 130 is preferably adjacent a reduced thickness section 112 of the housing 110 when the tubular carrier 120 is positioned within housing 110. By reducing the thickness section 112 adjacent a charge 130, the force necessary for a charge 130 to perforate the housing 110 is reduced, permitting more force to be directed to perforating the formation.

Referring now to FIGS. 1 and 2, the perforating gun 100 is stabilized by the tubular carrier 120. The housing 110 and the tubular carrier 120 may be sized so that the outside diameter 222 of the tubular carrier 120 meets (but does not necessarily engage) the inside diameter 212 of the housing 110. By forming the outside diameter 222 of the tubular carrier 120 to meet the inside diameter 212 of the housing 110, wall 228 increases the collapsible-pressure rating for the housing 110 when the tubular carrier 120 is positioned within housing 110. In operation, some of the force concentrically compressing housing 110 as a result of pressure in the wellbore may be transferred to the tubular carrier 120. While housing 110 and the tubular carrier 120 may be sized so the outside diameter 222 of the tubular carrier 120 merely meets the inside diameter 212 of the housing 110, due to the forces concentrically compressing housing 110, it may be preferred that the housing 110 and the tubular carrier 120 actually be joined by an interference fit. The distance between the outside diameter 222 of the tubular carrier 120 and the inside diameter 212 of the housing 110 may therefore impact the ability to transfer or share loads between the housing 110 and the tubular carrier 120. Likewise, the thickness of the wall 228 defined between the inside diameter 242 of the tubular carrier 120 and the outside diameter 222 of the tubular carrier 120 may impact the stability of the housing 110. An increase in the thickness of the wall 228 and the closer it is positioned to the housing 110 may therefore, improve the stability and collapsible-pressure rating of the housing 110 during perforating operations. To further increase the collapsible-pressure rating of the housing 110, the tubular carrier 120 may be composed, at least partially, of a material having a high strength, such as steel.

Moreover, the tubular carrier 120 may improve perforation results depending on the placement and size of each charge 130. Each charge 130 has a wall 234 partially positioned in opening 124 and therefore, near the housing 110 when carried by the tubular carrier 120. Each charge 130 may be integral with the tubular carrier 120. The forward end 226 of each charge 130 is positioned in the opening 124 between the inside diameter 242 and the outside diameter 222. As a result, each charge 130 is positioned adjacent the housing 110, rather than within the inner diameter of a support sleeve. Positioning each charge 130 adjacent to the housing 110 eliminates the dissipation of force of each charge 130 at detonation over the thickness of the support sleeve. Similarly, as each charge 130 is positioned in opening 124, the size of each charge 130 is not limited by the inside of a support sleeve. Therefore, in conjunction with carrier 120, rather than a support sleeve, a larger charge 130 may be used within the housing 110.

Various improvements may also be realized regarding the efficiency and utility of the perforating gun 100. For example, each charge 130 may be positioned adjacent a reduced thickness section 112 of the housing 110 with its forward end 226 positioned in the opening 124. As a result, the force expended by charge 130 to perforate housing 110 is reduced as less material must be perforated. Additional openings 124 may also be formed on the tubular carrier 120 and a like number of charges 130 positioned therein to increase the scope and range of perforation. Thus, multiple perforations in the formation may be accomplished at various depths and angles within the formation. Each charge 130 may also be partially composed of steel, rather than softer metals, to reduce debris in the formation after each charge 130 is detonated. Such a charge will direct more of the force of the charge toward the formation.

Figure 3:
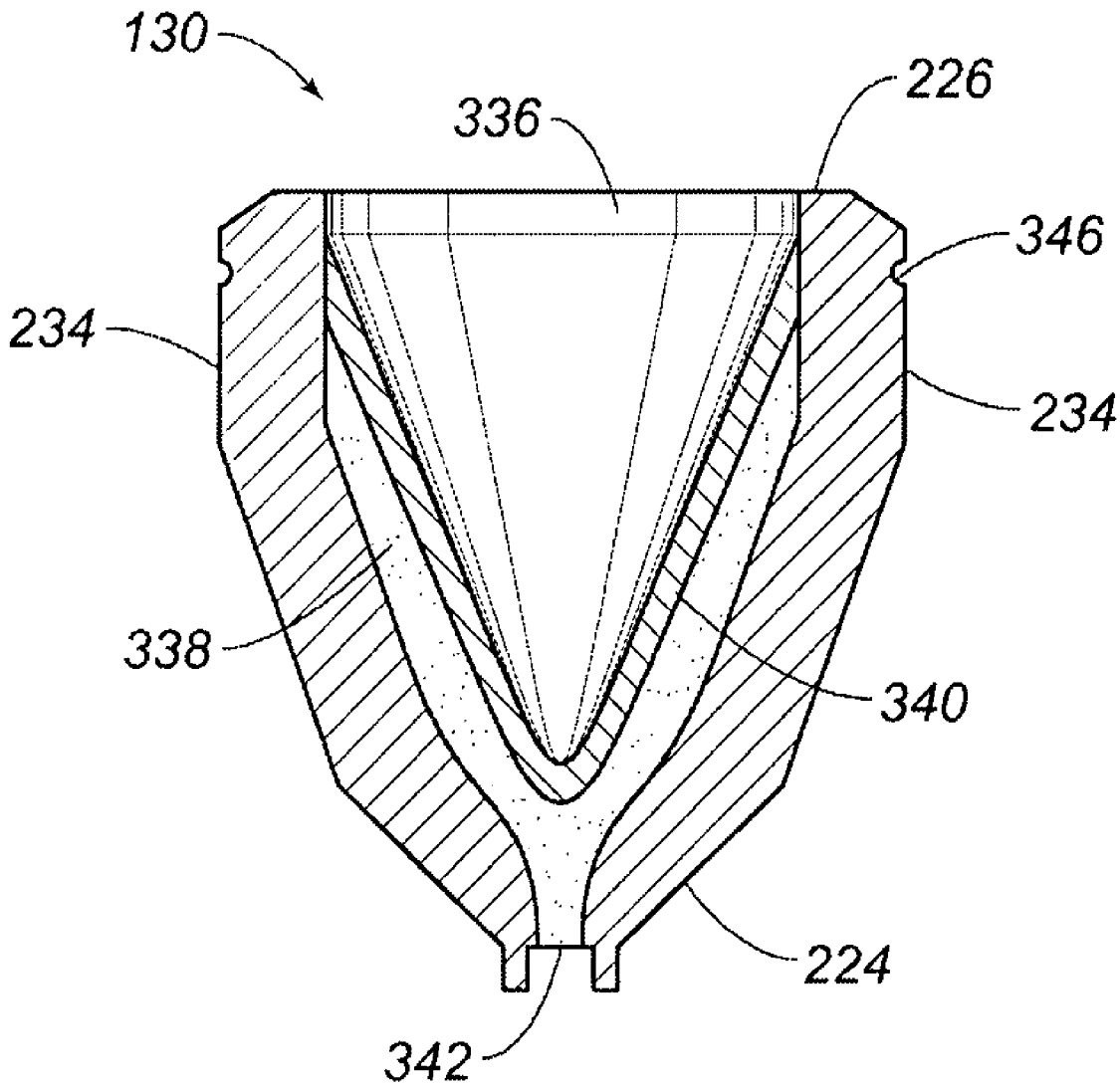
FIG. 3 is a cross-sectional view of the charge illustrated in FIG. 2.

Referring now to FIG. 3, the charge 130 may contain in its interior 336 an explosive 338. Additionally, the charge interior 336 may contain a liner 340 formed from a powdered metal mixture. As is known in the art, the shape and composition of liner 340 is selected to control the performance of the charge 130, including such characteristics as depth of penetration into the formation. Materials used for such liners are well known and include copper, graphite, tungsten, lead, nickel and tin. The purpose of these metals is to allow a reasonably homogeneous mixture with specific properties. Such shaped charge configurations achieve maximum penetration by projecting a continuous rod or a stream of particles, in near perfect alignment, against a target material.

The explosive 338 forms a conical surface against which liner 340 is pressed, thus liner 340 is cone-shaped. The charge 130 has a forward end 226 and a rearward end 224. An opening 342 may be disposed through the rearward end 224. A detonating cord 102 (FIGS. 1 and 2) may be positioned at the rearward end 224 of the charge 130 in contact with the explosive 338. Upon detonation, the explosive 338 collapses liner 340 and forms a jet, which penetrates the housing 110, preferably through the reduced thickness section 112.

Each charge 130 may be temporarily secured to the tubular carrier 120 by various means well known in the art such as a twist lock, a snap ring, a clip, a tab or an o-ring 252. An o-ring 252, for example, may be secured within a groove 230 in wall 228 of the tubular carrier 120 and within a groove 346 in the wall 234 of the charge 130 as illustrated in FIGS. 2 and 3. To obtain maximum contact between the tubular carrier 120 and each charge 130, the o-ring 252 is positioned between the inside diameter 242 of the tubular carrier 120 and the outside diameter 222 of the tubular carrier 120. By virtue of the concave shape of the opening 124, positioning the o-ring 252 anywhere else other than between the inside diameter 242 and the outside diameter 222 would result in the o-ring 252 being located at a position not entirely bounded by the tubular carrier 120.

The perforating gun 100 may be made in different ways using different materials than those described thus far. In one method, for example, the perforating gun 100 may be made with a tubular housing 110 partially composed of steel. A tubular carrier 120, having an inside diameter 242, an outside diameter 222 and an opening 124 disposed between the inside diameter 242 and the outside diameter 222, is also prepared and may be made, in part or in whole, with steel. A charge 130, partially composed of steel and containing an explosive 338, is partially inserted within each opening 124 of the tubular carrier 120. The tubular carrier 120 may then be inserted into the housing 110, which has an inside diameter 212 that meets the outside diameter 222 of the tubular carrier 120.

Various improvements in the method of making the perforating gun 100 may also be realized. These may include, alone or in combination, connecting each charge 130 to a detonation cord 102, preparing another opening 124 in the tubular carrier 120 for receipt of another charge 130 and inserting each charge 130 within the opening 124 from either an exterior of the tubular carrier 120 or an interior of the tubular carrier 120. Other improvements in the method of making the perforating gun 100 may also include temporarily securing each charge 130 to the tubular carrier 120 and holding each charge 130 in place by various means known in the art such as an o-ring 252. Moreover, the step of inserting the tubular carrier 120 into the housing 110 may further include positioning each charge 130 adjacent a reduced thickness section 112 of the housing 110.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention. Therefore, it is manifestly intended that this invention be limited only by the following claims and equivalents thereof.

The invention claimed is:

1. An apparatus for stabilizing a perforating gun having a tubular housing, the apparatus comprising:

a tubular carrier having a wall and an opening disposed through the wall, wherein the tubular carrier is positioned within the housing and the wall increases a collapsible-pressure rating for the housing; and a charge carried by the tubular carrier, the charge having a wall partially positioned in the opening.

2. The apparatus of claim 1 wherein the charge contains an explosive.

3. The apparatus of claim 2 wherein the charge further comprises a rearward end and an opening therein.

4. The apparatus of claim 1 wherein the charge is integral with the tubular carrier.

5. The apparatus of claim 1 wherein the charge is positioned adjacent a reduced thickness section of the housing.

6. The apparatus of claim 1 further comprising another opening in the tubular carrier and another charge partially positioned within the another opening.

7. The apparatus of claim 1 wherein the tubular carrier is partially composed of steel.

8. An apparatus for a perforating gun having a tubular housing, the apparatus comprising:

a tubular carrier comprising an inside diameter, an outside diameter and an opening disposed between the inside diameter and the outside diameter, wherein the tubular carrier is positioned within the housing and increases a collapsible-pressure rating for the housing; and a charge carried by the tubular carrier, the charge comprising a forward end positioned in the opening between the inside diameter and the outside diameter.

9. The apparatus of claim 8 wherein the charge contains an explosive.

10. The apparatus of claim 9 wherein the charge further comprises a rearward end and an opening therein.

11. The apparatus of claim 10 further comprising a detonating cord positioned at the rearward end of the charge in contact with the explosive.

12. The apparatus of claim 8 wherein the charge is integral with the tubular carrier.

13. The apparatus of claim 8 further comprising another opening in the tubular carrier and another charge partially positioned within the another opening.

14. The apparatus of claim 8 where the tubular carrier is partially composed of steel.

15. A method for making a perforating gun having a tubular housing, the method comprising:

preparing a tubular carrier, the tubular carrier having an inside diameter, an outside diameter and an opening disposed between the inside diameter and the outside diameter;

inserting a charge containing an explosive partially within the opening of the tubular carrier; and inserting the tubular carrier into the housing, the housing comprising an inside diameter that circumferentially meets the outside diameter of the tubular carrier.

16. The method of claim 15 further comprising connecting the charge to a detonation cord.

17. The method of claim 15 wherein inserting the charge further comprises temporarily securing the charge within the opening of the tubular carrier with an o-ring.

18. The method of claim 15 wherein a portion of the tubular carrier is prepared using steel.

19. The method of claim 15 further comprising preparing another opening in the tubular carrier for receipt of another charge.

* * * * *